United States Patent [19]

Luperti et al.

[11] Patent Number: 4,640,506

[45] Date of Patent: Feb. 3, 1987

[54] REVERSE COLLATING MACHINE

[75] Inventors: Harry E. Luperti, Wilton; Robert Irvine, Riverside; Anthony Luvara, Stamford, all of Conn.

[73] Assignee: Pitney Bowes Inc., Stamford, Conn.

[21] Appl. No.: 791,889

[22] Filed: Oct. 28, 1985

[51] Int. Cl.[4] ..... B65H 31/36

[52] U.S. Cl. ..... 271/212; 271/245; 414/92

[58] Field of Search ..... 271/212, 245, 246, 3.1, 271/216, 202, 203, 270; 414/92; 148/462, 423; 83/88

[56] References Cited

U.S. PATENT DOCUMENTS

| | | | |
|---|---|---|---|
| 1,819,841 | 8/1931 | Hudson | 271/212 |
| 2,748,917 | 6/1956 | Rawe | 198/423 |
| 2,987,314 | 6/1961 | Monaghan | 271/212 |
| 3,374,875 | 3/1968 | Griner | 198/462 |
| 3,871,539 | 3/1975 | Nikkel | 414/92 |
| 4,541,764 | 9/1985 | Govan et al. | 414/43 |

*Primary Examiner*—D. C. Butler
*Assistant Examiner*—John A. Carroll
*Attorney, Agent, or Firm*—Lawrence E. Sklar; Melvin J. Scolnick; David E. Pitchenik

[57] ABSTRACT

An improvement in a collating machine for stacking sheets of paper being fed seriatim thereto from a singulating feeder in the same order as the sheets appear in the singulating feeder. The collating machine includes a belt for transporting the sheets of paper, a ramp for lifting a succeeding sheet of paper over and onto a preceding, stopped sheet of paper, and a stopping device for stopping each sheet of paper after the sheet has been lifted by the ramp. The improvement includes a removable stacking device for stacking the sheets of paper in the reverse order as the sheets appear in the singulating feeder.

5 Claims, 12 Drawing Figures

REVERSE COLLATING MACHINE

BACKGROUND OF THE INVENTION

The instant invention relates to a collating machine and more particularly to a collating machine having the dual capability of stacking sheets of paper in the same or reverse order in which they are fed to the collating machine.

Collating machines are frequently used in line with other paper handling equipment as a means of assembling a plurality of sheets of paper into a particular, desired packet prior to further processing, which may include additional collating, folding, and inserting. For further background, reference can be made to U.S. Pat. Nos. 2,766,569 and 4,143,981. In a typical paper handling sequence involving an initial output consisting of a plurality of sheets of paper, to be later combined with subsequent output from other feeders downstream, the initial output is fed from a stack seriatim to the collator, which collates the output into the desired packets, either in the same order as the sheets had when they were in the precollator stack or the reverse order. Each packet is then folded and subsequently combined with other output from document feeders located downstream thereof and ultimately inserted into an envelope.

In many cases it happens that the initial output to be collated arrives in an opposite order so that the collator needs to collate in an opposite manner to enable the documents to emerge from the collator in the proper sequence for subsequent handling. In such a case, the only real option is to have a second line of paper handling equipment which includes a collator having reverse collating capability. Clearly, this is not a desirable option to users of paper handling equipment.

Accordingly, the instant invention provides an improvement in a collating machine permitting the same collating machine to be used for collating in the same or reverse order as the documents are fed to the collator. Changing the collating order of the machine requires only a few minutes of an operator's time to add or remove a few parts and is easily accomplished with the instant invention.

Summary of the Invention

In accordance with the foregoing, the instant invention provides an improvement in a collating machine for stacking sheets of paper being fed seriatim thereto from a singulating feeder in the same order as the sheets appear in the singulating feeder. The collating machine includes belt means for transporting the sheets of paper, ramp means for lifting a succeeding sheet of paper over and onto a preceding, stopped sheet of paper, and means for stopping each sheet of paper after the sheet has been lifted by the ramp means. The improvement comprises removable means for stacking the sheets of paper in the reverse order as said sheets appear in the singulating feeder.

DETAILED DESCRIPTION

Figure 1:
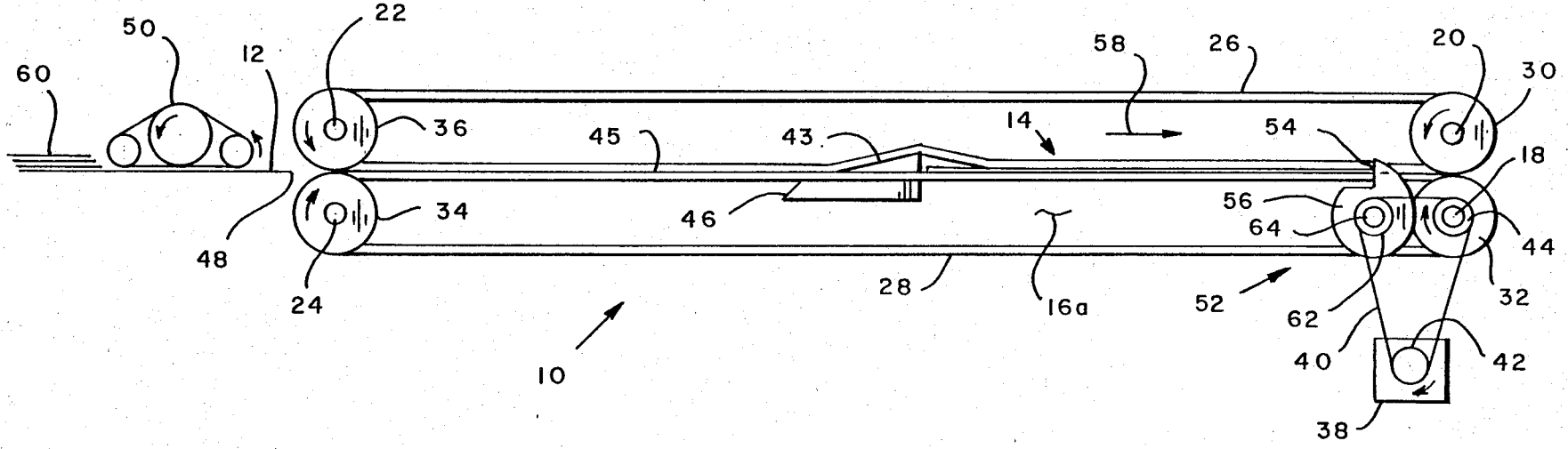
FIG. 1 PRIOR ART
FIG. 1 is a side elevational view of a prior art, inline collating machine.
Figure 2:
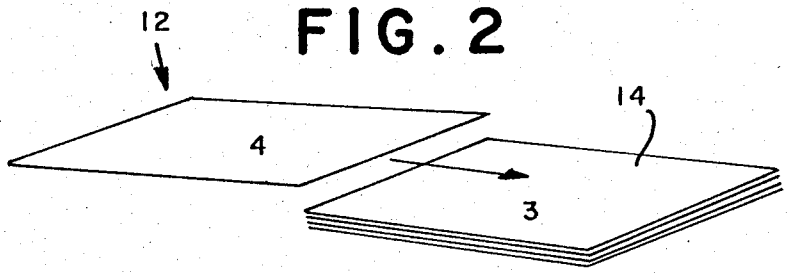
FIG. 2 is a perspective view showing a stack of paper sheets being collated in order.

In describing the preferred embodiment of the instant invention, reference is made to the drawings wherein a typical collating arrangement featuring a collating machine 10 as seen in FIG. 1. The collating machine 10 is schematically illustrated for accumulating a plurality of sheets 12 in order as shown in FIG. 2, that is, in FIG. 2 a stack 14 of sheets 12 is arranged so that the first sheet 12 is deposited first, i.e., the first sheet 12 is positioned on the bottom of the stack 14. This is accomplished by means of a suitable, cooperating, conveying apparatus within the collating machine 10. The conveying apparatus is formed between frames (not shown) which suspend a pair of driven shafts (see FIG. 1) 18 and 20 and a pair of idler shafts 22 and 24. There is a plurality of suitable, elastic conveyor belts 26 and 28 which are suspended over suitable pulleys 30, 32, 34 and 36 all of which are operatively connected to their respective shafts. There is an AC motor 38, which is provided with a drive member 40, which is in turn appropriately engaged with pulleys 42 and 44, in turn which are operatively connected to their respective shafts.

A plurality of sheet elevating ramps 43 are rigidly suspended and interposed between the belts 26 and 28 along a conveying path 45 for the sheets 12 so that a lower end 46 of a ramp 43 typically intercepts a leading end 48 of the sheets 12 as they are individually conveyed along path 45, having been separated by an upstream singulating feeder 50. When the sheets 12 reach the ramp 43, they are slightly elevated so that each sheet 12 will deposit upon the preceding sheet 12 which is registered at a cyclable registration device 52. The sheets 12 accumulate between the cooperating surfaces of the belts 26 and 28, and stop against a vertical surface 54 formed on plurality of disks 56 which are laterally interposed between the belts 26 and 28. The leading edge 48 of each sheet 12 therefore remains in contact with the surfaces 54 of the disks 56 since the belts 26 and 28 continue to urge the stack of sheets 14 in a downstream direction 58. It will be noted that the stack of sheets 14 is in the same order in which they were separated at the singulating feeder 50, since the feeder 50 advances the sheets 12 one at a time from the bottom of a supply stack 60 which is continuously shingled as shown in FIG. 1.

When the collating machine 10 has accumulated the required number of sheets 12 in the registered position at the cyclable registration device 52, a predetermined electronic control device (not shown) provides power to a 24 volt D.C. electromagnetic clutch device 62, which then rotatably engages a shaft 64 having the disks 56 suspended and mounted coaxially therewith. The clutch device 62 is rotatably coupled to the drive member 40, and the stack of sheets 14 is then advanced along the path 45 in the downstream direction 58 to, for example, a folding machine 65 (see FIG. 4). Subsequent operations are then provided to the stack of sheets 14, such as folding, as previously discussed.

Figure 4:
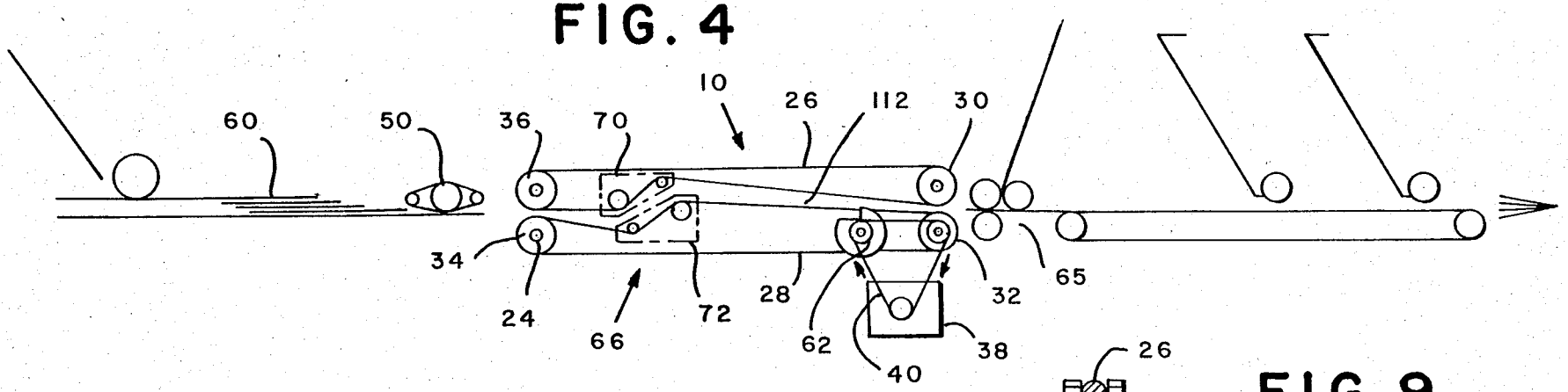
FIG. 4 is a side, elevational view of an in-line collating machine in accordance with the instant invention.
Figure 9:
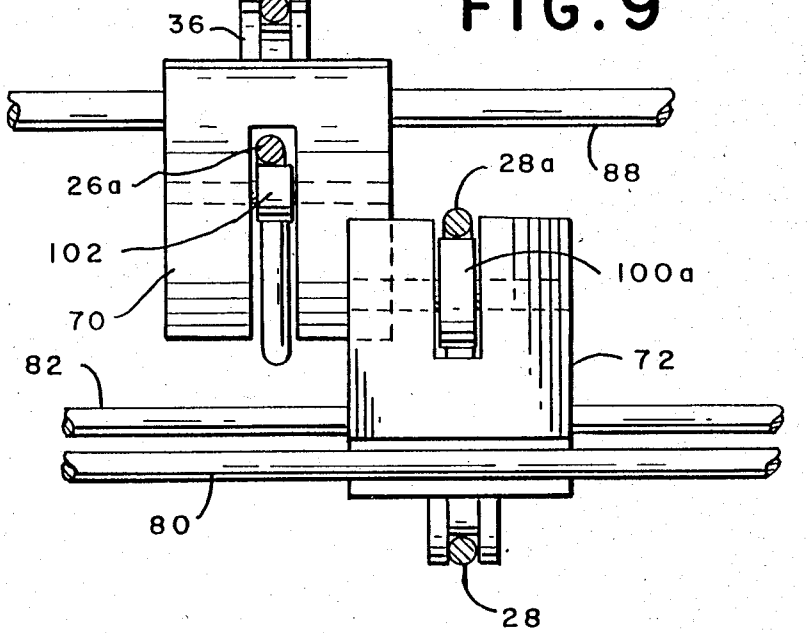
FIG. 9 is a sectional view taken on the plane indicated by the line 9—9 in FIG. 8.
Figure 3:
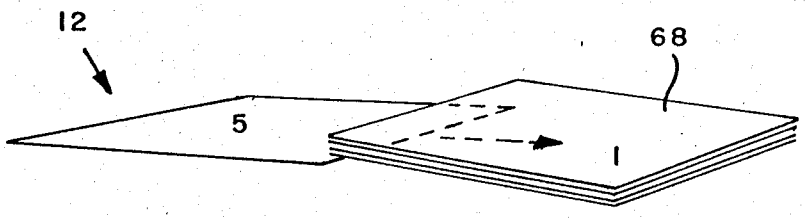
FIG. 3 is the same as FIG. 2 except that the stack of paper sheets is being collated in reverse order.

Referring to FIG. 4, there is shown the same collating machine 10 as previously described, with the exception that a sheet ramp apparatus 66 has been added. It is pointed out that the sheet elevating ramps 43 of the preceding described machine remain in place. It will become evident that the apparatus 66 is such that it is easily installed in the machine 10 by an operator who requires that the sheets 12 be accumulated into a stack 68 as shown in FIG. 3, i.e., that the sheets 12 are to be stacked in reverse order from which they were separated by the feeder 50.

Figure 5:
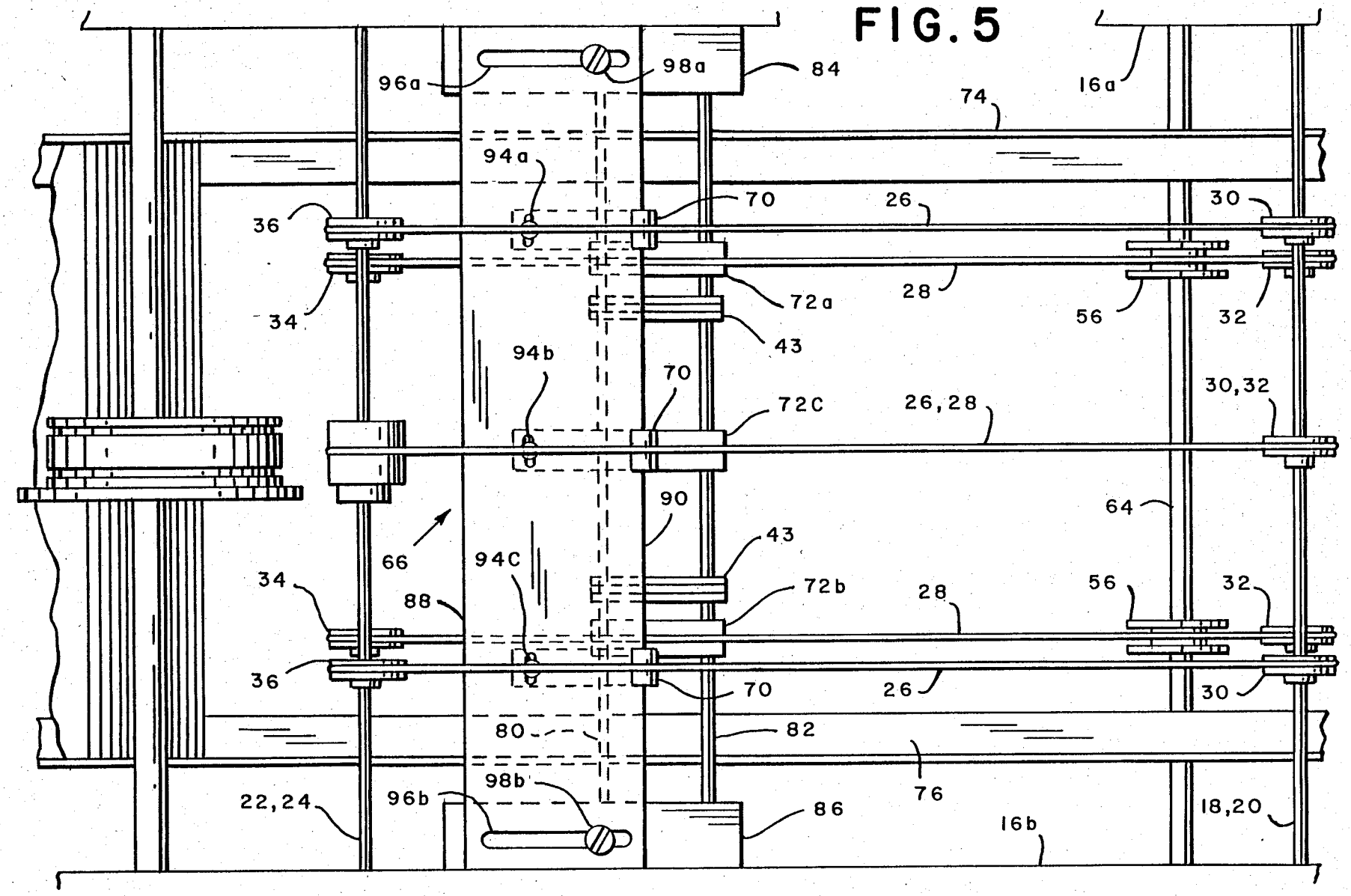
FIG. 5 is a top, plan view of the collating machine seen in FIG. 4.

Referring now to FIG. 4, there is seen the same collating machine 10, which utilizes the belts 26 and 28, and the same suspension, drive and framework previously described. There is a first removable ramp guide block 70, and a second removable ramp guide block 72 which are each provided in a set of three as seen in FIG. 5. The first blocks 70 are equally separated and disposed between a sheet edge guide 74 and 76, and are located to cooperate with the belts 26 and 28 as will be described in more detail hereinbelow.

Figure 6:
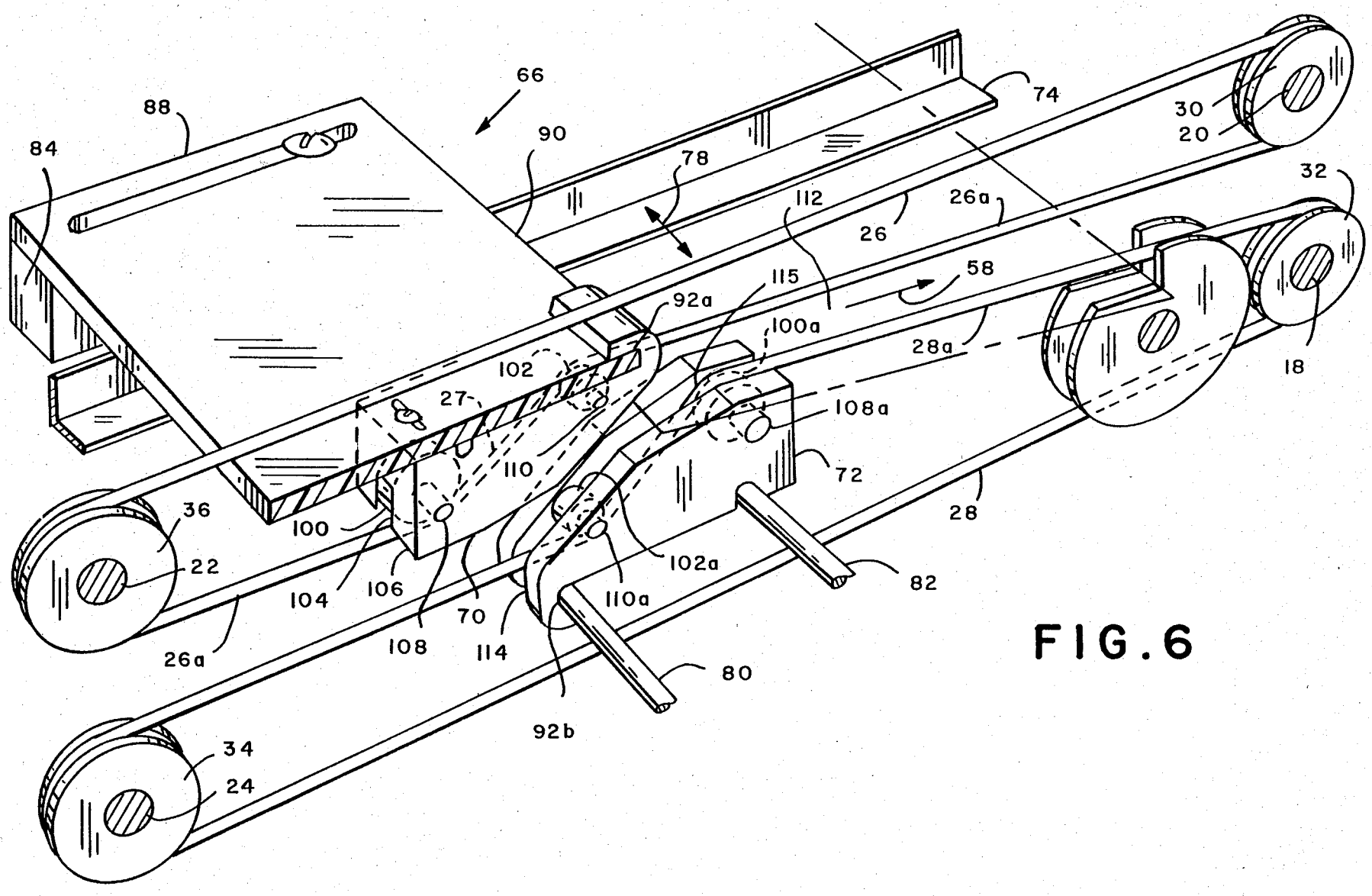
FIG. 6 is a perspective view, broken away, of the collating machine seen in FIG. 5.
Figure 7:
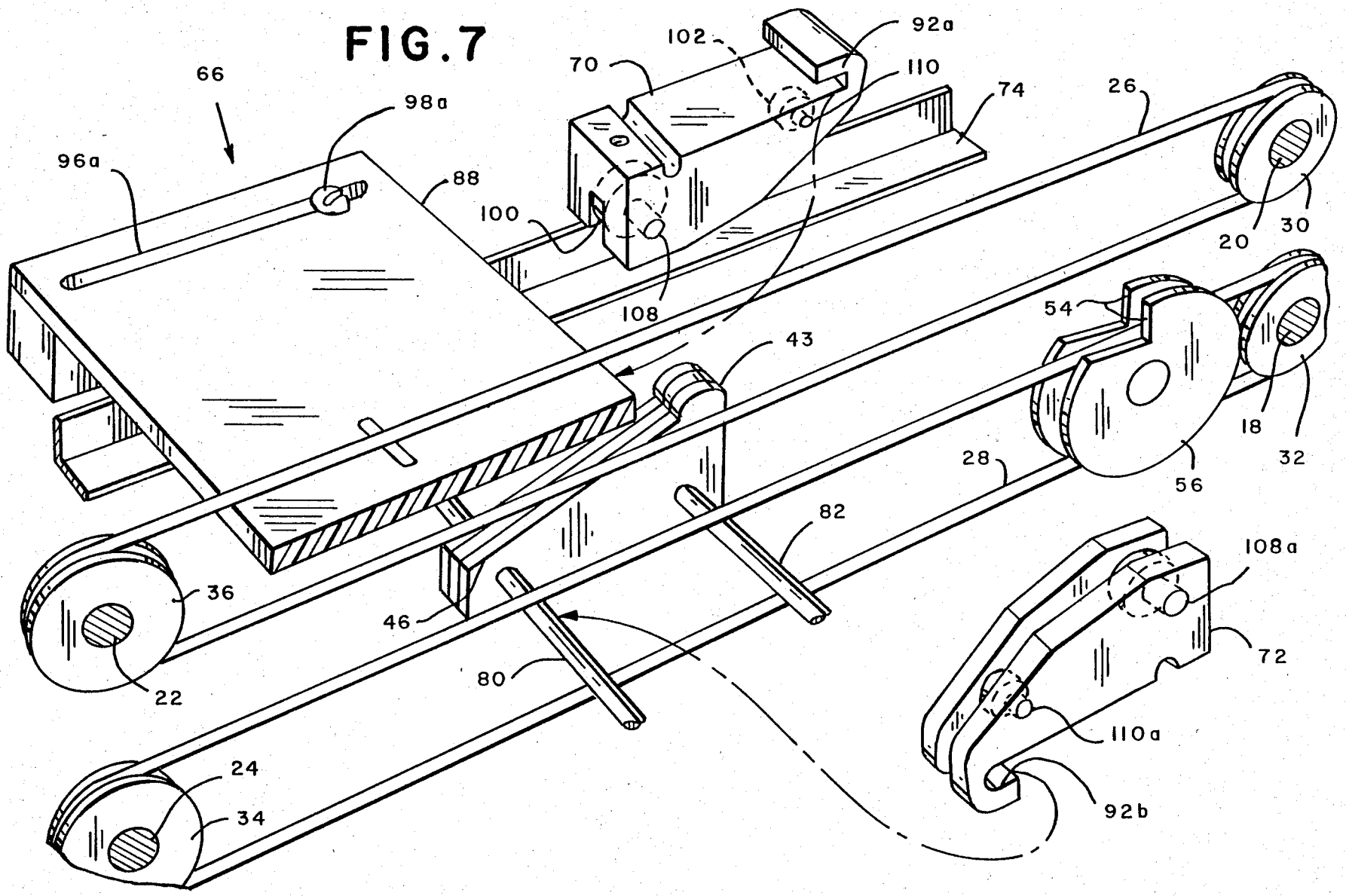
FIG. 7 is the same as FIG. 6 except it shows an upper and a lower ramp guide block removed from the collating machine.
Figure 8:
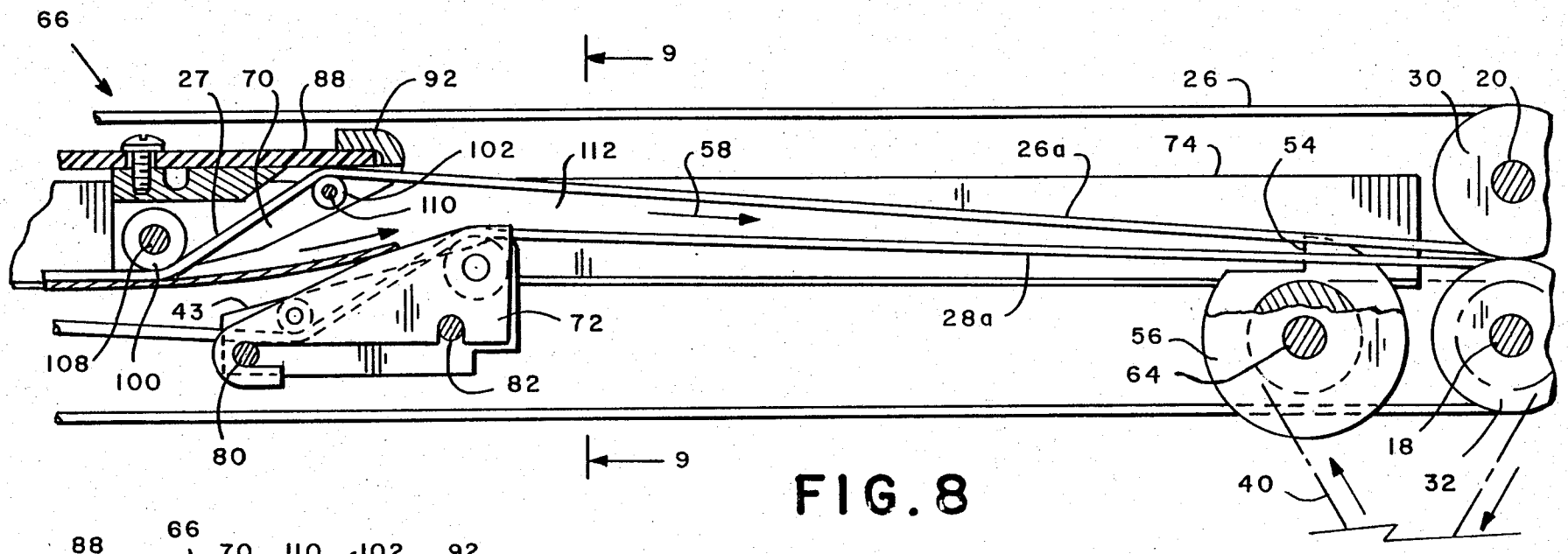
FIG. 8 is a side, elevational view of the collating machine seen in FIG. 5 showing a first sheet of paper being fed between the ramp guide blocks.

Referring to FIG. 6, the construction of the belts 26 and 28 are seen to be of an "O" ring nature. However, it is possible to utilize a flat belt, as long as the belt material is elastic, or there is provided an adequate belt tensioning system, the likes of which are well known by those skilled in the art.

The sheet ramp apparatus 66 is generally installed into the machine 10 by utilization of a few structural parts which suspend the blocks 70 and 72 in a predetermined position in the direction 58, as well as in a lateral direction 78. The frames **16*a* and 16*b* are used to mount suitable bearings for all of the rotating, or rotatable shafts previously described, and there are a number of fixed, elongated members which are used to locate and fasten the sheet ramp apparatus 66. For example (see FIG. 5), there is a rod 80 and a rod 82 which span the frames 16*a* and 16*b* and are located in holes in spacer blocks 84 and 86, which in turn are appropriately secured to the inside surface of the frame 16*a* and 16*b*. There is a generally flat, rectangular, plastic member 88 which is used to anchor the first ramp guide blocks 70 in a generally horizontal direction. An edge 90 of the member 88 cooperates with a slot opening 92*a* (see FIG. 6) on each block 70, and screws 94*a*, 94*b* and 94*c* clamp the blocks 70 against vertical movement. The plastic member 88 has slots 96*a* and 96*b*, and there are screws 98*a* and 98*b* which clamp the member 88 to the blocks 84 and 86 respectively. The slots 96*a* and 96*b* enable adjustment of the member 88 with the attached blocks 70 in the direction 58** as will be described hereinbelow.

FIG. 6 illustrates the sheet ramp apparatus 66 in detail, and shows the resuspended path of each of the belts 26 and 28 which cause the effect of the invention. The blocks 70 typically have rollers 100 and 102, each of which is centrally located in a lateral direction in a slot 104 on a bottom side 106. There are removable pins 108 and 110 for rotatably suspending the rollers 100 and 102 respectively. The pins 108, **108*a* and 110 and 110*a* are removable to enable an operator to easily install the apparatus 66 as is required. Alternately, removing the pins 108, 108*a* and 110 and 110*a* allows conversion of the collator 10 to regular order stacking. A lower reach 26*a* of the upper belt 26 has an engaged portion 27 suspended under the roller 100 and over the top side of the roller 102 such that a sheet receiving space 112 exists between an upper reach 28*a* of the belt 28 (see FIGS. 4 and 6) and the lower reach 26*a* of the belt 26**.

Figure 11:
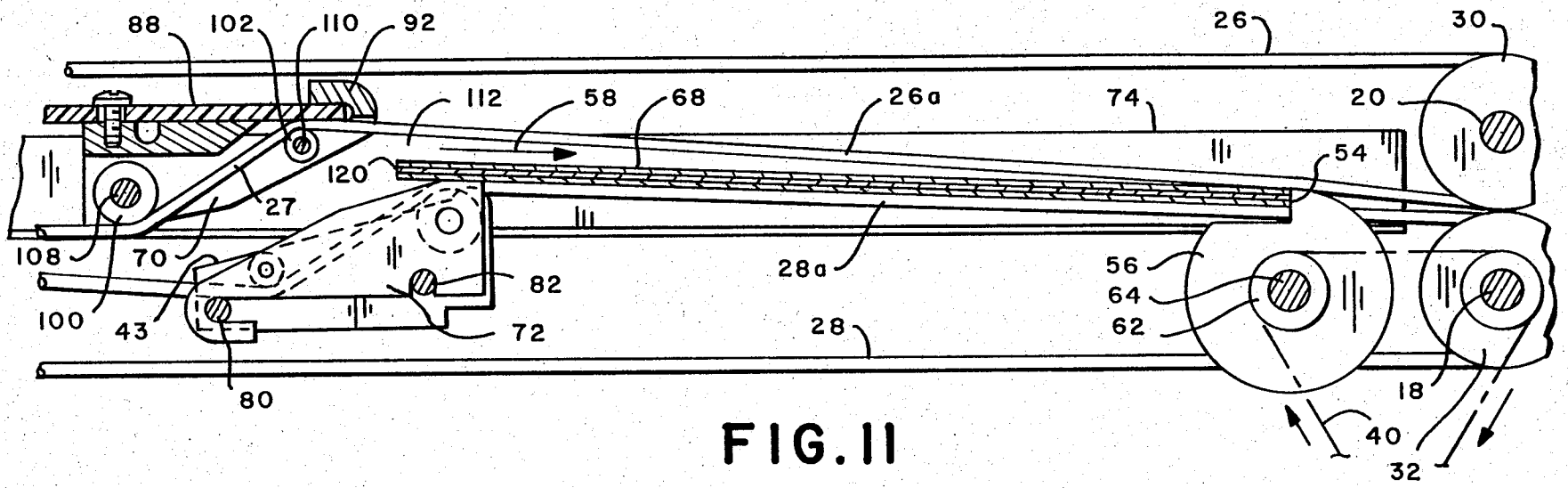
FIG. 11 is the same as FIG. 10 except that three sheets of paper have now been stopped and collated into a registered stack.
Figure 12:
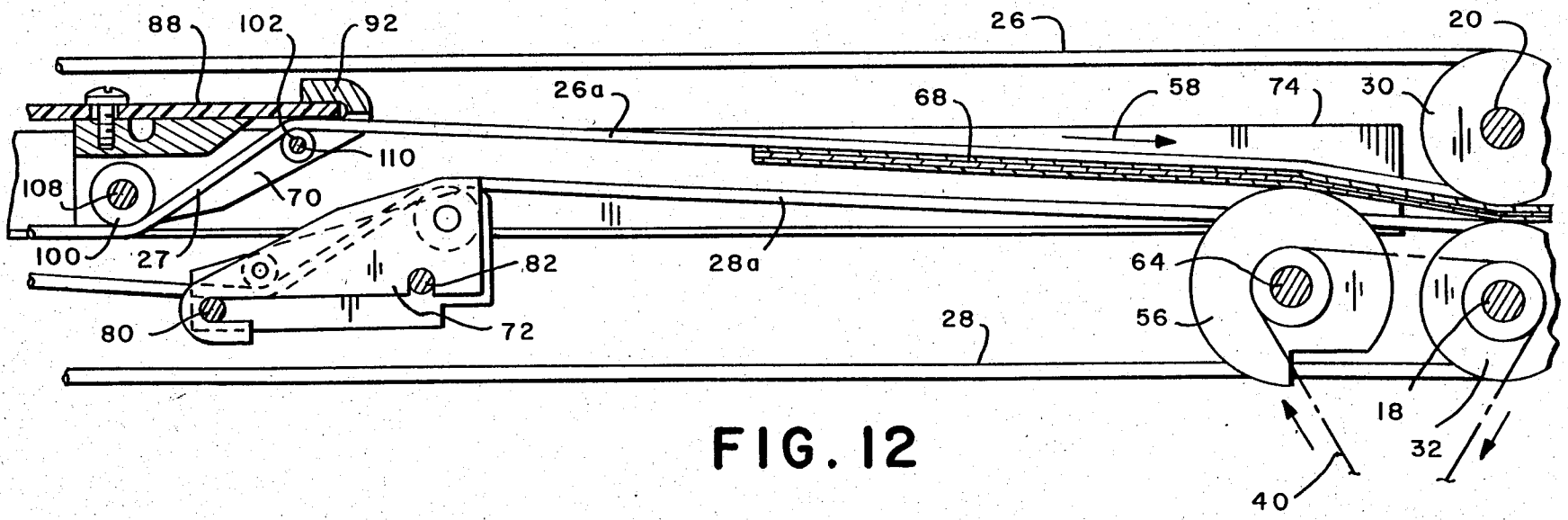
FIG. 12 is the same as FIG. 11 except that the registered stack is seen being fed out from the collating machine preparatory to further processing.

The blocks 72 are arranged laterally to accommodate the belts 26 and 28 which are slightly offset by a small lateral dimension. For example, in FIG. 5, block **72*a* is positioned slightly inside (towards the center) of the belt 26, and block 72*b* is positioned slightly inside of the belt 26. The block 72*c* is aligned directly beneath the block 70 however. Each block 72 has a slot 114 (see FIG. 6) centrally located within the block 72 in a lateral direction, within which there is a roller 100*a* and 102*a* which are further rotatably mounted on removable pins 108*a* and 110*a* respectively. The upper reach 28*a* of the belt 28 has an engaged portion 115 suspended under the roller 102 and over the roller 100*a*. There is, in effect, a predetermined angle of about 135° between the engaged portions 27 and 115 of the belts 26 and 28 respectively. It will be noted that the engaged portions 27 and 115 of the belts 26 and 28 are spaced apart in a substantially parallel relationship. Referring to FIG. 11, the view of the side of the collating machine 10 affords the opportunity to see that there is a stack of documents, previously noted as stack 68, which is located in the slot receiving space 112. The leading end of the stack 68 is registered against the vertical surfaces 54 of the disks 56 such that the stack 68 is ready for advancement in the direction 58 when a predetermined engagement of the clutch 62** occurs.

Figure 10:
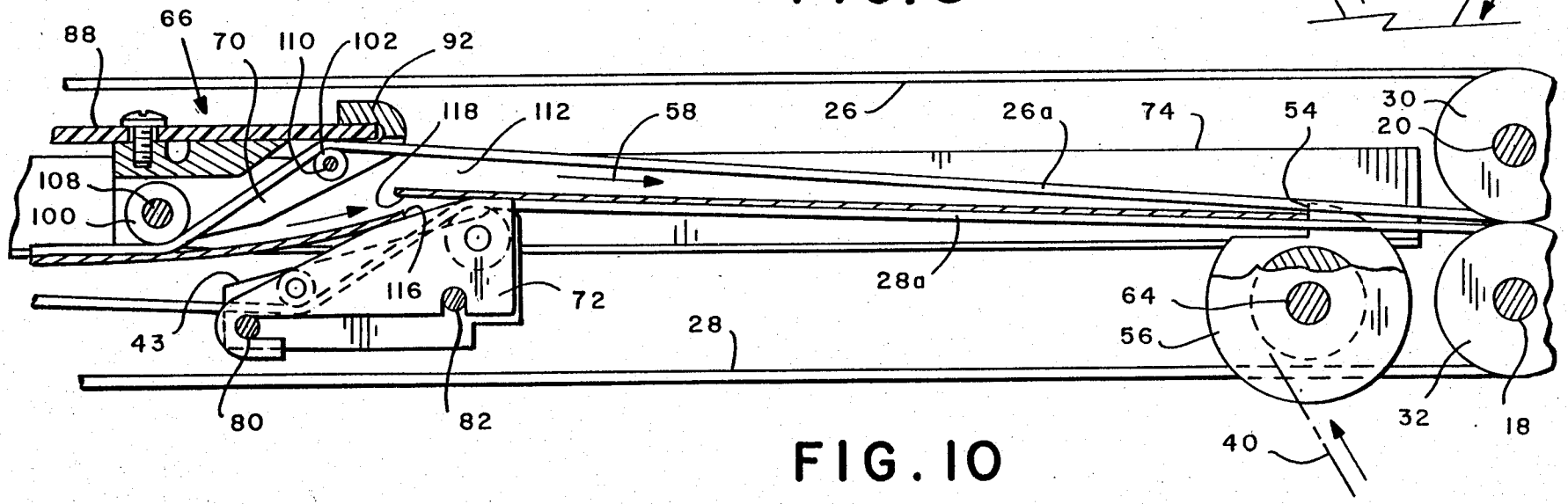
FIG. 10 is the same as FIG. 8 except that the first sheet of paper has been stopped and a second sheet of paper is being fed between the ramp guide blocks and under the first sheet of paper.

The significant effect of the arrangement previously described is noted in FIG. 10 where it is seen that as sheets move along direction 58, the leading end of a sheet 116 is guided to engage a bottom side 118 of the stack 68, which in effect is the latter sheet to be fed from the feeder 50. In other words, the stack 68 is arranged in reverse order from the original order in the supply stack 60 adjacent the feeder 50.

It is possible, and will be necessary, to adjust the sheet ramp apparatus 66 such that a trailing end 120 (see FIG. 11) of the stack 68 has sufficient clearance with respect to the first ramp guide block 70. The adjustment is provided through the slots **96*a* and 96*b* in the plastic member 88 when screws 98*a* and 98*b* are loosened and tightened appropriately while the sheet stack 68 is in the space 112. It will be necessary to make the foregoing adjustment whenever the length of the sheets 12 change as well. For example, the standard lengths of 11" and 14" will be accommodated by the apparatus described. The adjustment additionally allows the operator to ensure that the sheets enter the space 112** with a smooth, flowing motion.

Therefore, having briefly described an embodiment of the present invention which enables a machine operator to convert a collating machine from a mode where sheets are collated in one order, to an alternate mode where the sheets may be collated in reverse order, it will be evident that changes to the drawings or machine described herein will only enhance the present invention which is captured in the spirit and scope of the following claims.

What is claimed is:

1. In a collating machine for stacking sheets of paper being fed seriatim thereto from a singulating feeder in the same order as said sheets appear in said singulating feeder, said collating machine having at least one upper, endless, elastic belt and one lower, endless, elastic belt, each of said belts having an upper and a lower reach, and wherein the lower reach of the upper belt is situated slightly above the upper reach of the lower belt to thereby frictionally engage and transport said sheets of paper, ramp means for lifting a succeeding sheet of paper over and onto a preceding, stopped sheet of paper, said ramp means including a slot for receiving the lower reach of said lower belt, and means for stopping each sheet of paper after said sheet has been lifted by said ramp means, the improvement comprising removable means for stacking said sheets of paper in the reverse order as said sheets appear in said singulating feeder.

2. The improvement set forth in claim 1, wherein said removable reverse order stacking means comprises a first and a second removable ramp guide block, said first block being located adjacent and engaging a portion of the lower reach of the upper belt and the second block being located downstream of the first block and adjacent the upper reach of the lower belt, said second block engaging a portion of said upper reach of the lower belt.

3. The improvement of claim 2, wherein the engaged belt portions are disposed at a predetermined angle with respect to adjacent, non-engaged belt portions.

4. The improvement of claim 3, wherein the predetermined angle is about 135 degrees.

5. The improvement of claim 4, wherein said belts comprise O-ring belts.

* * * * *